US005269160A

United States Patent [19]

Wood

[11] Patent Number: 5,269,160

[45] Date of Patent: Dec. 14, 1993

[54] SELF-CENTERING DRIVE SYSTEM FOR AN AUTOMATIC WASHER

[75] Inventor: Douglas E. Wood, Hagar Township, Berrien County, Mich.

[73] Assignee: Whirlpool Corporation, Benton Harbor, Mich.

[21] Appl. No.: 905,615

[22] Filed: Jun. 29, 1992

[51] Int. Cl.[5] ..... D06F 23/04; D06F 37/40

[52] U.S. Cl. ..... 68/23.7

[58] Field of Search ..... 68/23.7, 133

[56] References Cited

U.S. PATENT DOCUMENTS

| | | | |
|---|---|---|---|
| 2,255,505 | 9/1941 | Dunham | 68/133 X |
| 2,893,268 | 7/1959 | Liebel | 74/801 |
| 3,797,331 | 3/1974 | Kjeldsteen | 74/752 E |
| 4,317,343 | 3/1982 | Gerry | 68/23.7 |
| 4,455,889 | 6/1984 | Hauser | 74/713 |
| 4,759,229 | 7/1988 | Takahashi et al. | 74/409 |
| 4,890,465 | 1/1990 | Burk et al. | 68/23.7 |
| 4,910,979 | 3/1990 | Burk et al. | 68/23.7 |
| 4,969,341 | 11/1990 | Burk et al. | 68/23.7 |
| 5,000,016 | 3/1991 | Burk et al. | 68/23.7 |

*Primary Examiner*—Philip R. Coe
*Attorney, Agent, or Firm*—Stephen D. Krefman; Thomas J. Roth; Thomas E. Turcotte

[57] ABSTRACT

A self-centering drive system is provided in an automatic washer wherein the input drive shaft and the output agitator shaft are drivingly connected by a planetary gear system. A bearing system is provided for the output drive shaft to allow the output drive shaft to seek the best operating center with respect to the input drive shaft and a surrounding ring gear member. Reduced noise, bearing wear and cost advantages are achieved.

10 Claims, 1 Drawing Sheet

SELF-CENTERING DRIVE SYSTEM FOR AN AUTOMATIC WASHER

BACKGROUND OF THE INVENTION

1. Field of the Invention

The present invention relates to drive systems for automatic clothes washers, and more particularly to an improved drive system having a bearing system for an output agitator shaft connected to an input drive shaft through a planetary gear system.

2. Description of the Prior Art

Typically, automatic washers utilize a drive system for connecting a motor with an agitator and a wash basket. Preferably, the drive system allows the agitator to be oscillated while the wash basket is held stationary during an agitate mode. In a water extraction or "spin" mode, the agitator and the wash basket are spun together. It is known to use a planetary gear system, for example as shown in commonly assigned U.S. Pat. No. 4,969,341, for connecting an input drive shaft, operatively connected to a motor, to an output agitator shaft, operatively connected to an agitator. Typically, a bearing system is provided for controlling radial position and restricting relative radial movement between both the input drive shaft and the output agitator shaft relative to each other. Precision machining of the bearing support surfaces is required for precise alignment of the operating centers of both the input drive shaft and output agitator shaft.

The above described drive system has several disadvantages. The precision machining required for precise alignment of the operating centers of the input drive shaft and the output agitator shaft is relatively expensive. Furthermore, error in alignment of the operating centers of the drive shaft and agitator shaft may occur, which increases gear wear and causes relatively high noise levels.

It would therefore be an improvement in the art if a less expensive, more accurate, and more easily assembled drive system were provided which would allow for self-alignment of the operating centers of the input drive shaft and output agitator shaft.

SUMMARY OF THE INVENTION

The present invention contemplates an automatic washer having a vertical axis agitator, rotatably mounted in a wash basket, and a motor drivingly connected to the agitator and wash basket by means of a planetary gear system to selectively oscillate the agitator within the basket or rotate the agitator and basket about a vertical axis.

In an exemplary embodiment, the vertically aligned drive system includes a drive shaft having a bottom end connected to the motor and having a top end connected to a sun gear. An agitator shaft, generally aligned above the drive shaft, has a top end operatively connected to the agitator and a bottom end operatively connected to planetary gears. The sun gear drives the planetary gears and a ring gear, operatively connected to the wash basket, surrounds the planetary gears. A bearing system is provided for radially locating the drive shaft relative to the planetary gear system and substantially constraining radial movement of both the top and bottom end. A second bearing system is provide for radially locating and substantially constraining radial movement of the top end of the agitator shaft relative to the planetary gear system and allowing the bottom end radial movement relative to the planetary gear system such that the bottom end of the agitator shaft may seek a best operating center with respect to the sun and the ring gear.

A primary object of the present invention therefore, is to provide a bearing system structure for allowing radial movement of the bottom end of the agitator shaft, thereby reducing gear wear and noise. Another object of the present invention is the reduction of machining required for the bearing system thereby reducing costs. Another object of the present invention is to reduce the number of parts included in the bearing system, thereby reducing assembly labor and cost Other objects and advantages of the present invention may become apparent to those skilled in the Art, upon reference to the accompanying description when taken in conjunction with the following drawings.

DESCRIPTION OF THE PREFERRED EMBODIMENT

Figure 1:
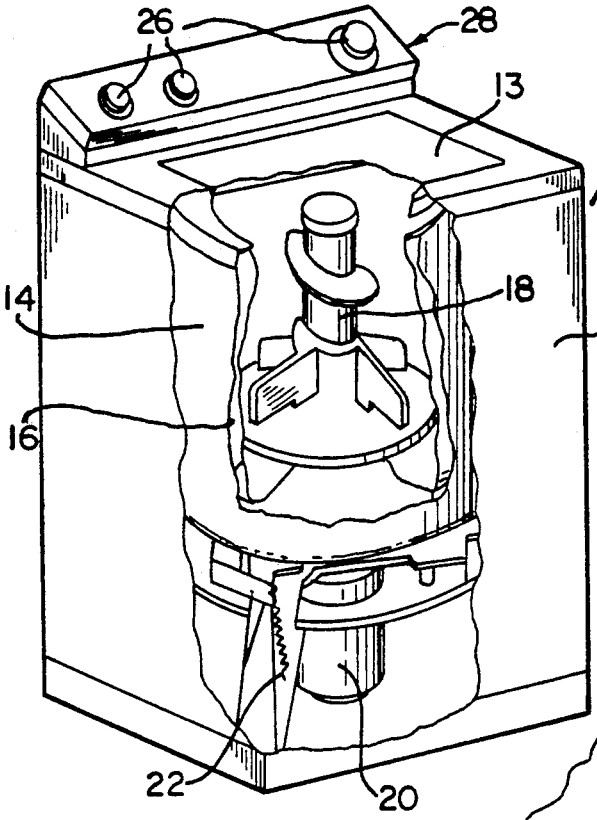
FIG. 1 is a perspective view with parts cut away of an automatic washer embodying the principles of the present invention.

Referring now to the drawing, and more particularly FIG. 1, there is illustrated an automatic washer generally at 10 embodying the principles of the present invention. The washer has an outer cabinet 12 with an hinged lid 13 which encloses an imperforate wash tub 14 for receiving a supply of wash liquid. Concentrically mounted within the wash tub 14 is a wash basket 16 for receiving a fabric load to be washed and a vertical axis agitator 18. A motor 20 is provided which is drivingly connected, through drive assembly 29 described below, to the agitator 18 to drive it in an oscillatory or rotary manner. The motor 20 is also selectively connectable, through drive assembly 29 described below, to the basket 16 for simultaneous rotation with the agitator 18. The assembly of the tub 14, the wash basket 16, agitator 18, and the motor 20 is mounted on a suspension system 22. A plurality of controls 26 are provided on a control console 28 for automatically operating the washer through a series of washing, rinsing, and liquid extracting steps.

Figure 2:
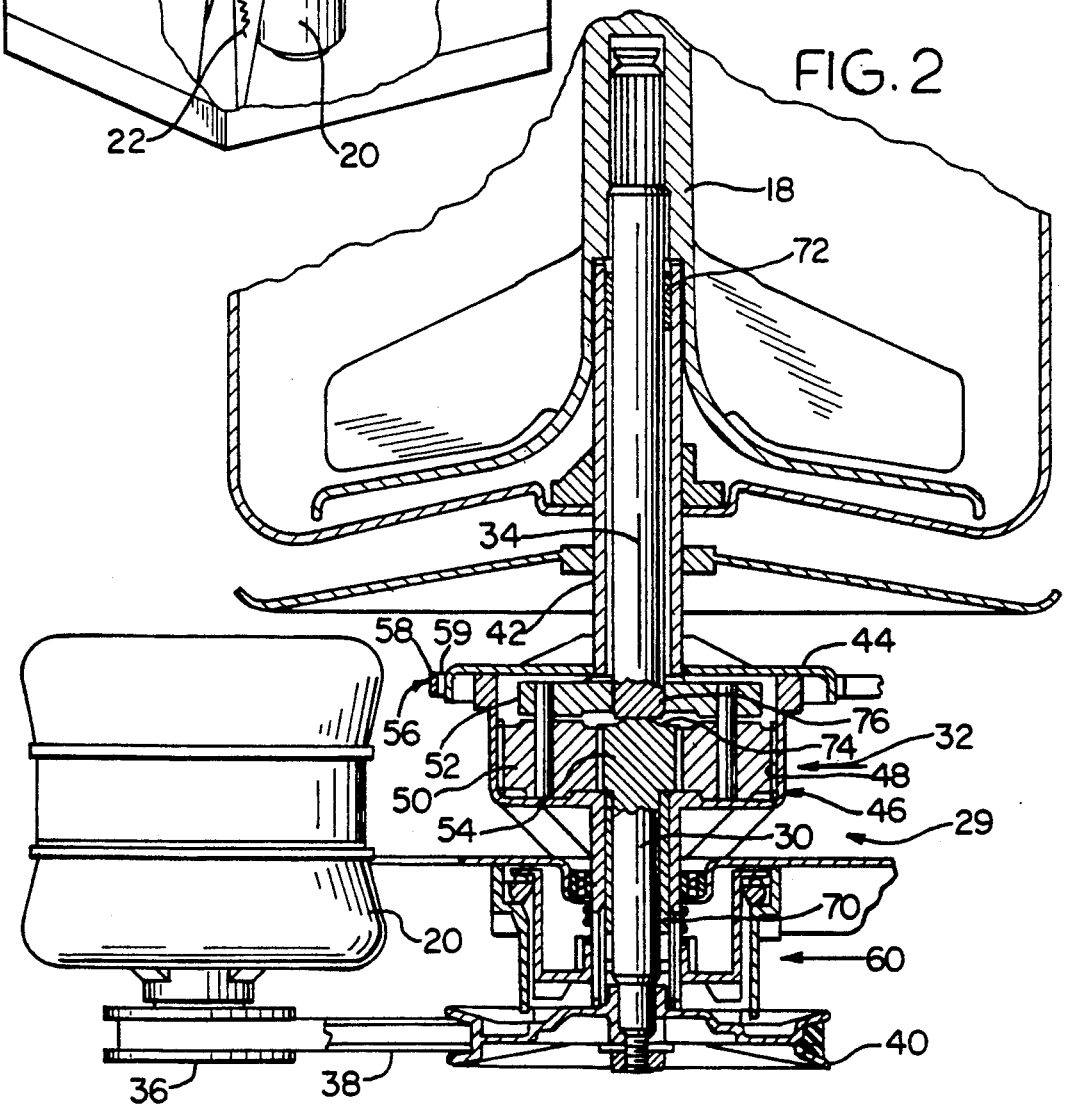
FIG. 2 is a side sectional view of the agitator and drive system of the washer of FIG. 1.

The drive assembly 29 is shown in greater detail in FIG. 2, where it is shown that the motor 20 is operatively connected to a planetary gear assembly 32 through a drive shaft 30 having a sun gear 54 directly connected to the top of the drive shaft 30. The sun gear 54 drives a plurality of planet gears 50 connected to the bottom of an agitator shaft 34 through use of a connecting carrier plate 52. The agitator shaft 34 is directly connected to the agitator 18. The wash basket 16 is connected to a spin tube 42, which is in turn connected to a top surface 44 of a gear housing 46. The gear housing 46 includes an outer ring gear member 48 which interacts with a plurality of planet gears 50. In this particular drive arrangement, the motor 20 may be a permanent split capacitor (PSC) motor, and is connected through a drive pulley 36 and a belt 38 to drive a driver pulley 40 affixed to the bottom of the drive shaft 30. The motor 20 may be reversely operated to provide oscillatory motion to the agitator.

When the washer is operating in the agitate mode, the motor 20 is operated in a reversing fashion which causes the drive shaft 30 to oscillate, thus driving the sun gear 54 in alternating opposite directions. The agitator 18 is therefore oscillated through its connection with the planet gears 50. The wash basket is held stationary during this operation, and to provide the means for holding the basket stationary, a band brake mechanism shown generally at 56 may be provided. The band brake mechanism 56 includes a brake band 58 having a high friction interior lining 59 which is engageable with at least a portion of the circumference of the hub 44 connected to the basket 16. The band brake 56 may be constructed and actuated as disclosed in commonly assigned and copending U.S. application No. 214,592, filed Jul. 1, 1988, the specification of which is incorporated by reference herein.

Generally, in the agitate mode, the agitator 18 is oscillated through an angle of approximately 180° to 240° during each stroke. Often, it is desirable to hold the wash basket fixed relative to the wash tub during the agitate mode. This is accomplished by leaving the brake mechanism 56 in an "on" condition. However, during the water extraction step, the basket 16 is spun with the agitator 18. During this step the brake mechanism 56 is released from frictional engagement with the hub 44.

A clutch mechanism is required to provide a way of switching between oscillatory movement of the agitator relative to the basket, and spinning of the agitator with the basket. The clutch assembly 60 may be constructed and actuated as disclosed in commonly assigned U.S. Pat. No. 4,969,341 issued Nov. 13, 1990, the specification of which is incorporated by reference herein.

Looking further at FIG. 2, it can be seen that sleeve bearing 70 rotatably supports and radially constrains drive shaft 30. Said sleeve bearing 70 is of predetermined length to substantially limit radial and axial movement of both the top and bottom ends of drive shaft 30. The top end of drive shaft 30 terminates in a rounded bearing surface 74.

The present invention contemplates an improved and simplified bearing system for the agitator shaft 34. The agitator shaft 34 is constrained by a solitary or single sleeve bearing 72 located at the top of the agitator shaft 34. No sleeve bearing provided for the bottom end of the agitator shaft 34 which terminates in a hardened end 76. The hardened end 76 contacts the rounded bearing surface 74 providing vertical position control but no radial position control. The lower end of the agitator shaft 34 therefore is allowed to move radially so that the carrier plate 52 and planetary gears 50 seek an operating center with respect to the sun gear 54 and the outer ring gear 48.

The above-described agitator shaft constraint system provides for a reduced number of agitator shaft bearing supports This results in easier assembly and lower costs. Furthermore, precision machining of the spin tub 42 to align the solitary sleeve bearing 72 with another lower positioned sleeve bearing is eliminated by the elimination of a lower positioned sleeve bearing in the spin tube. Finally, as a result of the agitator shaft 34 seeking its own best operating center with respect to the sun gear 54 and the outer ring gear 48, improved gear alignment occurs, reducing gear wear and noise.

Although the present invention has been described with reference to a specific embodiment, those of skill in the art will recognize that changes may be made thereto without departing from the scope and spirit of the invention as set forth in the appended claims.

What is claimed is:

1. An automatic washer comprising:

a wash basket;

an agitator rotatably mounted in said wash basket;

a motor having an output shaft;

a drive shaft having a first end operatively connected to said output shaft of said motor and having a second end;

an agitator shaft generally aligned with said drive shaft and having a first end operatively connected to said agitator and a second end;

a planetary gear system having:

a sun gear operatively connected to said second end of said drive shaft, at least three planet gears operatively connected to said second end of said agitator shaft, a gear housing surrounding said sun gear and said planet gears, and having an inner surface, said inner surface having a ring gear, and said planet gears drivingly engaging said sun gear and said ring gear;

a spin tube concentrically disposed within said agitator and having a portion surrounding said agitator shaft, said spin tube being fixedly connected to said wash basket and said gear housing, said spin tube further being axially and radially constrained relative to said planetary gear system;

a bearing means interposed between said drive shaft and said gear housing for radially locating said drive shaft relative to said planetary gear system and substantially constraining radial movement of both the first and said second end of said drive shaft; and a bearing means interposed between said spin tube and said agitator shaft and located near said first end of said agitatory shaft such that said first end of said agitator shaft is substantially radially constrained relative to said spin tube while said second end of the agitator shaft is radially movable relative to said spin tube and said drive shaft such as to allow a best operating center with said sun gear and said ring gear.

2. The automatic washer as defined in claim 1 further comprising a carrier plate for connecting said planet gears to said agitator shaft.

3. The automatic washer as defined in claim 1 wherein said second end of said drive shaft further comprises a rounded bearing surface for frictional bearing contact with said second end of said agitator shaft.

4. In the automatic washer as defined in claim 1, wherein said bearing means for constraining radial movement of both said first and said second end of said drive shaft comprises a sleeve bearing having predetermined length for preventing radial movement of both said first and said second ends of said drive shaft.

5. The automatic washer as defined in claim 1, wherein said bearing means or constraining said agitator shaft comprises a sleeve bearing.

6. In an automatic washer having an agitator rotatably mounted in a wash basket and further having a drive system including a motor having an output shaft and a drive means operatively connected between said output shaft and said wash basket and said agitator, the improvement in said drive means comprising:

a drive shaft having a first end operatively connected to said output shaft of said motor and having a second end;

an agitator shaft generally aligned with said drive shaft and further having a first end operatively connected to said agitator and having a second end;

a planetary gear system having a sun gear operatively connected to said second end of said drive shaft, at least three planet gears operatively connected to said second end of said agitatory shaft and a ring gear operatively connected to said wash basket, said ring gear surrounding said planet gears and said sun gear, and said planet gears drivingly engaging said sun gear and said ring gear;

a spin tube surrounding said agitator shaft and being axially and radially constrained relative to said planetary gear system; and means for radially constraining said agitator shaft comprising:

a solitary agitator shaft bearing disposed near said first end of said agitatory shaft between said spin tube and said agitatory shaft for radially constraining said first end of said agitatory shaft relative to said spin tue, said driving engagement of said planet gears with said sun gear and said ring gear radially constraining said second end of said agitator shaft;

wherein radially movement of said second end of said agitatory shaft relative to said spin tube is allowed such that said second end of said agitatory shaft is radially movable relative to said drive shaft.

7. The improvement of claim 6, wherein said second end of said drive shaft further comprises a rounded bearing surface for frictional bearing contact with said second end of said agitator shaft.

8. The improvement of claim 6 further comprising a sleeve bearing for radially locating said drive shaft relative to said planetary gear system and substantially constraining radial movement of both said first and said second end of said drive shaft.

9. The improvement of claim 8, further comprising:

a gear housing surrounding said planet gears and said sun gear and further having an inner surface including said ring gear; and said spin tube disposed around said agitatory shaft having an upper portion connected to said wash basket and having a lower portion connected to said gear housing such that said ring gear is connected to said wash basket through said gear housing and said cylindrical spin tube.

10. The improvement of claim 9, wherein said bearing means for constraining radial movement of both said first and said second end of said drive shaft comprises a sleeve bearing interposed between said drive shaft and said gear housing having a predetermined length such as to prevent radial and axial movement of both said first and said second ends of said drive shaft.

* * * * *